US010070244B1

(12) United States Patent
Dabney

(10) Patent No.: US 10,070,244 B1
(45) Date of Patent: Sep. 4, 2018

(54) AUTOMATIC LOUDSPEAKER CONFIGURATION

(71) Applicant: Amazon Technologies, Inc., Seattle, WA (US)

(72) Inventor: William Clinton Dabney, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 103 days.

(21) Appl. No.: 14/870,505

(22) Filed: Sep. 30, 2015

(51) Int. Cl.
*H04R 5/02* (2006.01)
*H04S 7/00* (2006.01)
*H04R 5/04* (2006.01)

(52) U.S. Cl.
CPC ..... *H04S 7/301* (2013.01); *H04R 5/04* (2013.01); *H04S 7/303* (2013.01)

(58) Field of Classification Search
None
See application file for complete search history.

(56) References Cited

U.S. PATENT DOCUMENTS

2008/0226087 A1* 9/2008 Kinghorn ..... H04S 7/301 381/59
2011/0091055 A1* 4/2011 LeBlanc ..... H04S 7/301 381/303
2012/0148075 A1* 6/2012 Goh ..... H04S 7/301 381/303
2013/0287228 A1* 10/2013 Kallai ..... H04R 3/14 381/107
2015/0016642 A1* 1/2015 Walsh ..... H04S 7/301 381/307

* cited by examiner

*Primary Examiner* — James Mooney
(74) *Attorney, Agent, or Firm* — Lee & Hayes, PLLC

(57) ABSTRACT

An audio system has multiple loudspeaker devices to produce sound corresponding to different channels of a multichannel audio signal such as a surround sound audio signal. The loudspeaker devices may have speech recognition capabilities. In response to a command spoken by a user, the loudspeaker devices automatically determine their positions and configure themselves to receive appropriate channels based on the positions. In order to determine the positions, a first of the loudspeaker devices analyzes sound representing the user command to determine the position of the first loudspeaker device relative to the user. The first loudspeaker also produces responsive speech indicating to the user that the loudspeaker devices have been or are being configured. The other loudspeaker devices analyze the sound representing the responsive speech to determine their positions relative to the first loudspeaker device and report their positions to the first loudspeaker device. The first loudspeaker uses the position information to assign audio channels to each of the loudspeaker devices.

23 Claims, 7 Drawing Sheets

AUTOMATIC LOUDSPEAKER CONFIGURATION

BACKGROUND

Home theater systems and music playback systems often use multiple loudspeakers that are positioned around a user to enrich the perception of sound. Each loudspeaker receives a signal of a multi-channel audio signal that is intended to be produced from a specific direction relative to the listener. The assignment of channel signals to loudspeakers is typically the result of a manual configuration. For example, The loudspeaker at a particular position relative to a nominal user position may be wired to the appropriate channel signal output of an amplifier.

BRIEF DESCRIPTION OF THE DRAWINGS

The detailed description references the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
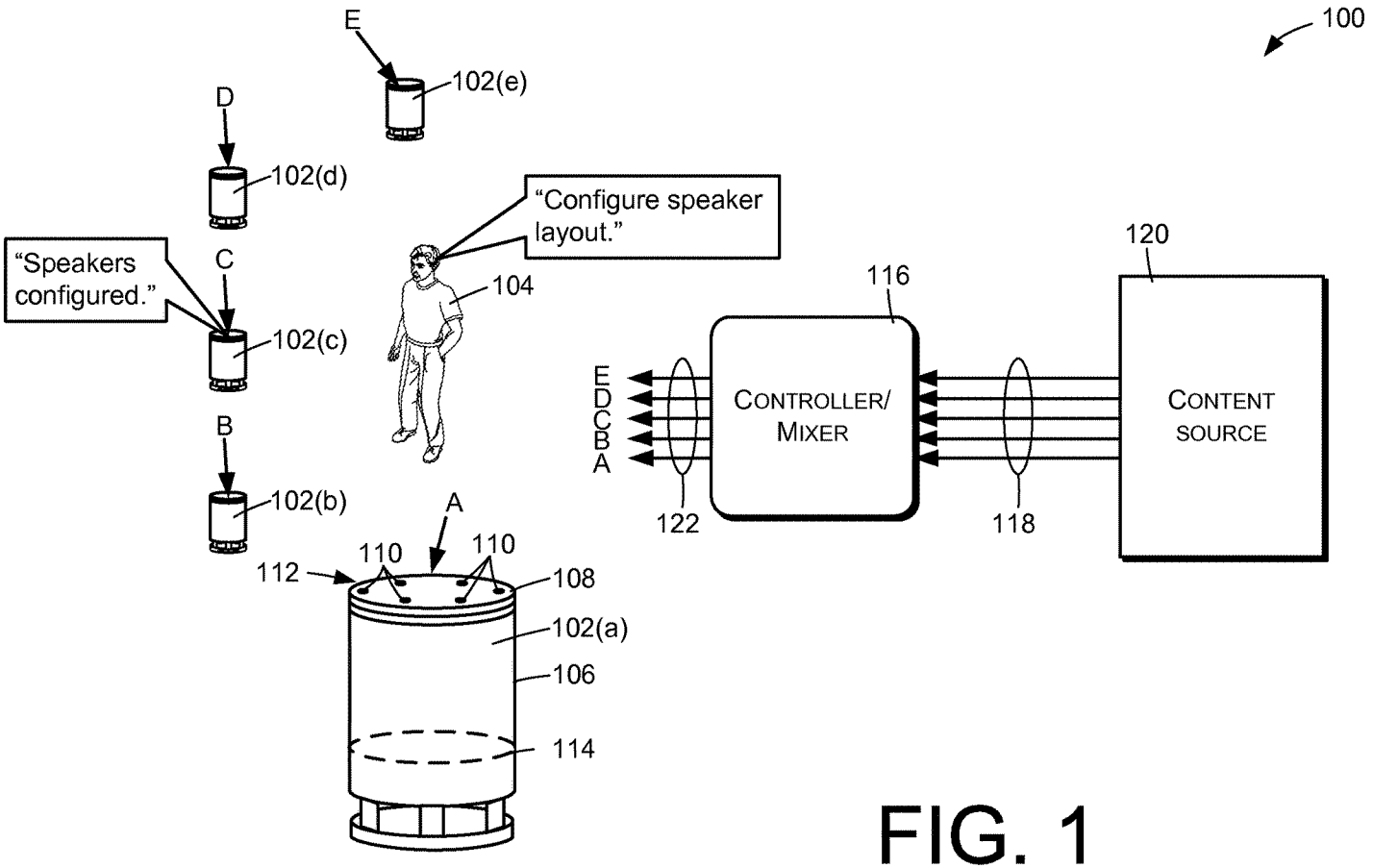
FIG. 1 is a block diagram of a system that performs automatic loudspeaker configuration based on speech uttered by a user and responsive speech produced by one of the loudspeakers.

Described herein are systems and techniques for automatically configuring a group of loudspeaker devices according to their positions relative to a user and/or to each other. In particular, such automatic configuration includes determining an association of individual channel signals of a multi-channel audio signal with respective loudspeaker devices based on the positions of the loudspeaker devices. The relative loudnesses of the loudspeaker devices are also adjusted to compensate for their different distances from the user.

In described embodiments, each loudspeaker device is an active, intelligent device having capabilities for interacting with a user by means of speech. Each loudspeaker device has a loudspeaker such as an audio driver element or transducer for producing speech, music, and other audio content, as well as a microphone array for receiving sound such as user speech.

The microphone array has multiple microphones that are spaced from each other so that they can be used for sound source localization. Sound source localization techniques allow each loudspeaker device to determine the position from which a received sound originates. Sound source localization may be implemented using time-difference-of-arrival (TDOA) techniques based on microphone signals generated by the microphone array.

The loudspeaker devices may be used as individual loudspeaker components of a multi-channel audio playback system, such as a two-channel stereo system, a six-channel system referred to as a "5.1" surround sound system, an eight-channel system referred to as a "7.1" surround sound system, etc. When used in this manner, the loudspeaker devices receive and play respectively different audio channels of a multi-channel audio signal. Each loudspeaker device in such a system has an assigned role, which corresponds to a reference position specified by a reference layout. A loudspeaker device that plays the left channel signal of a multi-channel audio signal is said to have the left role of the audio playback system. In some cases, particularly when actual positions of the loudspeakers do not correspond exactly to reference positions defined by a reference loudspeaker layout, a mix of two different audio channel signals may be provided to an individual loudspeaker device.

In described embodiments, the roles of the loudspeaker devices can be configured automatically and dynamically in response to a spoken user command. For example, the user may speak the command "Configure speaker layout," and one of the loudspeaker devices may reply by producing the speech "Loudspeakers have been configured." In the background, the loudspeaker devices may analyze both the user speech and the responsive speech produced by one of the loudspeaker devices to determine relative positions of the user and the loudspeaker devices, and to assign roles and/or audio channel signals to each of the loudspeaker devices based on the positions.

As an example, suppose a user speaks the command "Configure speaker layout." One of the loudspeaker devices, referred to herein as a "leader" device, performs automatic speech recognition to recognize or determine the meaning of the speech and to determine that the speech corresponds to a command to configure the loudspeaker devices. The leader device also analyzes the microphone signals containing the user speech using TDOA techniques to determine the position from which the speech originated and hence the position of the leader device relative to the user. The leader device also acknowledges the user command by producing sound, such as the speech "Speakers have been configured."

Each loudspeaker device other than the leader device detects the responsive speech produced by the leader device and analyzes its own microphone signals using TDOA techniques to determine its position relative to the leader device. These positions are reported to the leader device, which uses the information to calculate positions of all loudspeaker devices relative to the user.

Based on the determined positions of the loudspeaker devices, the leader device determines an association of each loudspeaker device with one or more audio channel signals. For example, this may be performed by comparing positions of the device positions relative to the user with reference positions defined by a reference layout. An analysis may then be performed to determine a channel signal association that minimizes differences between the actual device positions and the reference positions. In some cases, audio channels may be mixed between loudspeaker devices in order to more closely replicate the reference loudspeaker layout.

FIG. 1 shows an example audio system 100 implemented in part by multiple loudspeaker devices 102. A user 104 is illustrated in an arbitrary position relative to the loudspeaker devices 102. In the illustrated example, the system 100 includes five loudspeaker devices 102(*a*) through 102(*e*).

The first device 102(*a*) is enlarged to illustrate an example configuration. In this example, the device 102(*a*) has a cylindrical body 106 and a circular, planar, top surface 108. Multiple microphones or microphone elements 110 are positioned on the top surface 108. The multiple microphone elements 110 are spaced from each other for use in beamforming and sound source localization, which will be described in more detail below. More specifically, the microphone elements 110 are spaced evenly from each other around the outer periphery of the planar top surface 108. In this example, the microphone elements 110 are all located in a single horizontal plane formed by the top surface 108. Collectively, the microphone elements 110 may be referred to as a microphone array 112 in the following discussion.

In certain embodiments, the primary mode of user interaction with the system 100 is through speech. For example, a device 102 may receive spoken commands from the user 104 and provide services in response to the commands. The user 104 may speak a predefined trigger expression (e.g., "Awake"), which may be followed by instructions or directives (e.g., "I'd like to go to a movie. Please tell me what's playing at the local cinema."). Provided services may include performing actions or activities, rendering media, obtaining and/or providing information, providing information via generated or synthesized speech via the device 102, initiating Internet-based services on behalf of the user 104, and so forth.

Each device 102 has a loudspeaker 114, such as an audio output driver element or transducer, within the body 106. The body 106 has one or more gaps or openings allowing sound to escape.

The system 100 has a controller/mixer 116 that receives a multi-channel audio signal 118 from a content source 120. Note that the functions of the controller/mixer 116 may be implemented by any one or more of the devices 102. Generally, all of the device 102 have the same components and capabilities, and any one of the devices 102 can act as a controller/mixer 116 and/or perform the functions of the controller/mixer 116.

The devices 102 communicate with each other using a short-distance wireless networking protocol such as the Bluetooth® protocol. Alternatively, the devices 102 may communicate using other wireless protocols such as one of the IEEE 802.11 wireless communication protocols, often referred to as Wi-Fi. Wired networking technologies may also be used.

The multi-channel audio signal 118 may represent audio content such as music. In some cases, the content source 120 may comprise an online service from which music and/or other content is available. The devices 102 may use Wi-Fi to communicate with the content source 120 over various types of wide-area networks, including the Internet. Generally, communication between the devices 102 and the content source 120 may use any of various data networking technologies, including Wi-Fi, cellular communications, wired network communications, etc. The content source 120 itself may comprise a network-based or Internet-based service, which may comprise or be implemented by one or more servers that communicate with and provide services for many users and for many loudspeaker devices using the communication capabilities of the Internet.

In some cases, the user 104 may pay a subscription fee for use of the content source 120. In other cases, the content source 120 may provide content for no charge or for a charge per use or per item.

In some cases, the multi-channel audio signal 118 may be part of audio-visual content. For example, the multi-channel audio signal 118 may represent the sound track of a movie or video.

In some embodiments, the content source 120 may comprise a local device such as a media player that communicates using Bluetooth® with one or more of the devices 102. In some cases, the content source 120 may comprise a physical storage medium such as a CD-ROM, a DVD, a magnetic storage device, etc., and one or more of the devices 102 may have capabilities for reading the physical storage medium.

The multi-channel audio signal 118 contains individual audio channel signals corresponding respectively to the audio channels of multi-channel content being received from the content source 120. In the illustrated embodiment, the audio channel signals correspond to a 5.1 surround sound system, which comprises five loudspeakers and an optional low-frequency driver (not shown). The audio channel signals in this example include a center channel signal, a left channel signal, a right channel signal, a left rear channel signal, and a right rear channel signal. The controller/mixer 116 dynamically associates the individual signals of the multi-channel audio signal 118 with respective loudspeaker devices 102 based on the positions of the loudspeaker devices 102 relative to the user 104. The controller/mixer 116 may also route the audio signals to the associated loudspeaker devices 102. In some cases, the controller/mixer 116 may create loudspeaker signals 122 that are routed respectively to the loudspeaker devices, wherein each loudspeaker signal 122 is one of the individual signals of the multi-channel audio signal 118 or a mix of two or more of the individual signals of the multi-channel audio signal 118. In this example, the controller/mixer 116 provides a signal "A" to the device 102(*a*), a signal "B" to the device 102(*b*), a signal "C" to the device 102(*c*), a signal "D" to the device 102(*d*), and a signal "E" to the device 102(*e*).

FIG. 1 shows an example in which the user 104 has spoken the command "Configure speaker layout." The device 102(*c*) has responded with the speech "Speakers configured." Based on the user speech and the responsive device speech, the system has determined the positions of the devices 102 relative to the user 104 and has associated each of the devices 102 with one or more of the audio channel signals of the multi-channel audio signal 118. Subsequently, when receiving multi-channel audio content from the content source 120, the controller/mixer 116 provides each audio channel signal to the associated device 102, to be played by the device 102.

In addition to determining the associations between loudspeaker devices and audio channel signals, the controller/mixer 116 may also configure amplification levels or loudnesses of the individual channels to account for differences in the distances of the devices 102 from the user 104. For example, more distant devices 102 may be configured to use higher amplification levels than less distant devices, so that the user 104 perceives all of the devices 102 to be producing the same sound levels in response to similar audio content.

Figure 2:
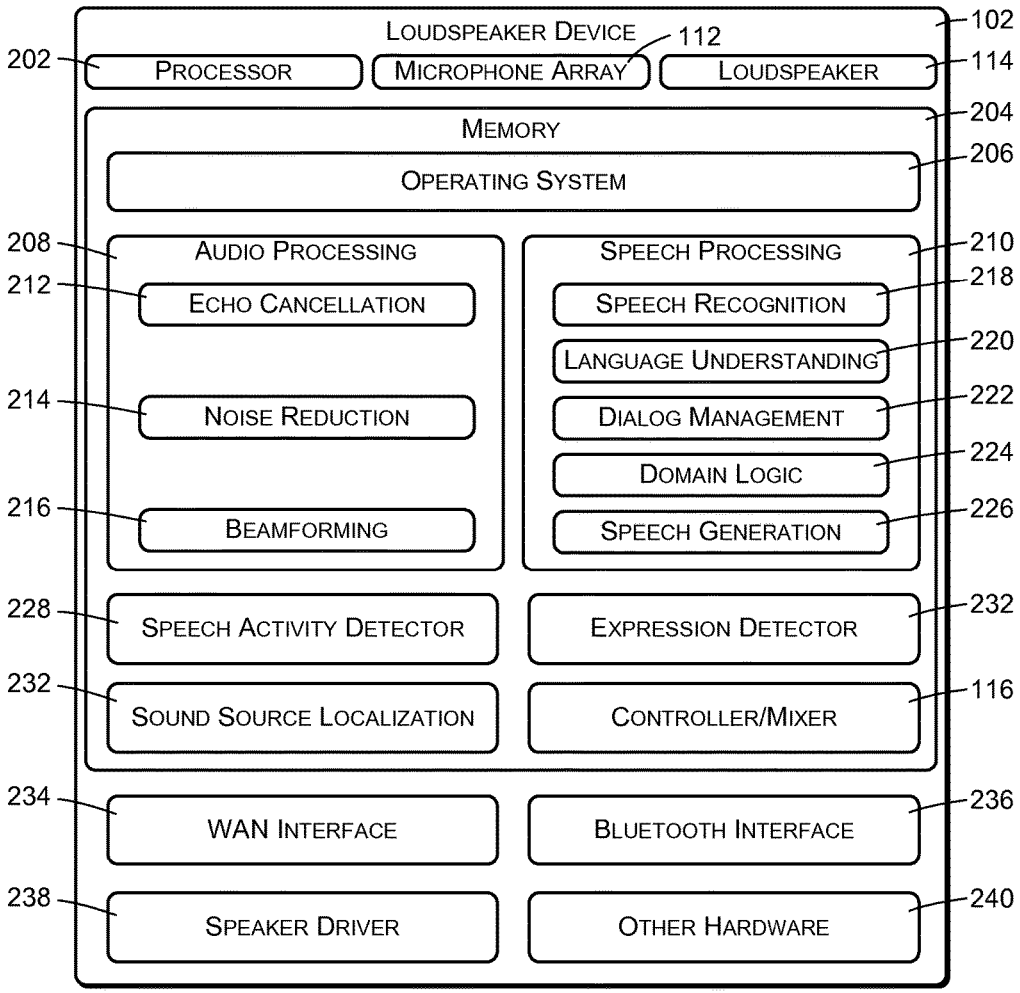
FIG. 2 is a block diagram of an example loudspeaker device that may be used to implement the automatic loudspeaker configuration techniques described herein.

FIG. 2 shows relevant components of an example loudspeaker device 102. In this example, the device 102 is configured and used to facilitate speech-based interactions with the user 104. Spoken user commands directed to the device 102 are prefaced by a wake word, which is more generally referred to as a trigger expression. In response to detecting the trigger expression, the device 102 or an associated network-based support service interprets any immediately following words or phrases as actionable speech commands.

The device 102 has a microphone array 112 and one or more loudspeakers or other audio output driver elements 114. The microphone array 112 produces microphone audio signals representing sound from the environment of the device 102 such as speech uttered by the user 104. The audio signals produced by the microphone array 112 may comprise directional audio signals or may be used to produce directional audio signals, where each of the directional audio signals emphasizes sound from a different radial direction relative to the microphone array 112.

The device 102 includes control logic, which may comprise a processor 202 and memory 204. The processor 202 may include multiple processors and/or a processor having multiple cores. The memory 204 may contain applications and programs in the form of instructions that are executed by the processor 202 to perform acts or actions that implement desired functionality of the device 102, including the functionality specifically described herein. The memory 204 may be a type of computer storage media and may include volatile and nonvolatile memory. Thus, the memory 204 may include, but is not limited to, RAM, ROM, EEPROM, flash memory, or other memory technology.

The device 102 may have an operating system 206 that is configured to manage hardware and services within and coupled to the device 102. In addition, the device 102 may include audio processing components 208 and speech processing components 210. The audio processing components 208 may include functionality for processing microphone audio signals generated by the microphone array 112 and/or output audio signals provided to the loudspeaker 114. The audio processing components 208 may include an acoustic echo cancellation or suppression component 212 for reducing acoustic echo generated by acoustic coupling between the microphone array 112 and the loudspeaker 114. The audio processing components 208 may also include a noise reduction component 214 for reducing noise in received audio signals, such as elements of microphone audio signals other than user speech.

The audio processing components 208 may include one or more audio beamformers or beamforming components 216 configured to generate directional audio signals that are focused in different directions. More specifically, the beamforming components 216 may be responsive to audio signals from spatially separated microphone elements of the microphone array 112 to produce directional audio signals that emphasize sounds originating from different areas of the environment of the device 102 or from different directions relative to the device 102.

The speech processing components 210 are configured to receive and respond to spoken requests by the user 104. The speech processing components 210 receive one or more directional audio signals that have been produced and/or processed by the audio processing components 208 and perform various types of processing in order to understand the intent expressed by user speech. Generally, the speech processing components 210 are configured to (a) receive a signal representing user speech, (b) analyze the signal to recognize the user speech, (c) analyze the user speech to determine a meaning of the user speech, and (d) generate output speech that is responsive to the meaning of the user speech.

The speech processing components 210 may include an automatic speech recognition (ASR) component 218 that recognizes human speech in one or more of the directional audio signals produced by the beamforming component 216. The ASR component 218 recognizes human speech in the received audio signal and creates a transcript of speech words represented in the directional audio signals. The ASR component 218 may use various techniques to create a full transcript of spoken words represented in an audio signal. For example, the ASR component 218 may reference various types of models, such as acoustic models and language models, to recognize words of speech that are represented in an audio signal. In many cases, models such as these are created by training, such as by sampling many different types of speech and by manual classification of the sampled speech.

In some implementations of speech recognition, an acoustic model represents speech as a series of vectors corresponding to features of an audio waveform over time. The features may correspond to frequency, pitch, amplitude, and time patterns. Statistical models such as Hidden Markov Models (HMMs) and Gaussian mixture models may be created based on large sets of training data. Models of received speech are then compared to models of the training data to find matches.

Language models describe things such as grammatical rules, common word usages and patterns, dictionary meanings, and so forth, to establish probabilities of word sequences and combinations. Analysis of speech using language models may be dependent on context, such as the words that come before or after any part of the speech that is currently being analyzed.

ASR may provide recognition candidates, which may comprise words, phrases, sentences, or other segments of speech. The candidates may be accompanied by statistical probabilities, each of which indicates a "confidence" in the accuracy of the corresponding candidate. Typically, the candidate with the highest confidence score is selected as the output of the speech recognition.

The speech processing components 210 may include a natural language understanding (NLU) component 220 that is configured to determine user intent based on recognized speech of the user 104. The NLU component 220 analyzes a word stream provided by the ASR component 218 and produces a representation of a meaning of the word stream. For example, the NLU component 220 may use a parser and associated grammar rules to analyze a sentence and to produce a representation of a meaning of the sentence in a formally defined language that conveys concepts in a way that is easily processed by a computer. The meaning may be semantically represented as a hierarchical set or frame of slots and slot values, where each slot corresponds to a semantically defined concept. NLU may also use statistical models and patterns generated from training data to leverage statistical dependencies between words in typical speech.

The speech processing components 210 may also include a dialog management component 222 that is responsible for conducting speech dialogs with the user 104 in response to meanings of user speech determined by the NLU component 220.

The speech processing components 210 may include domain logic 224 that is used by the NLU component 220 and the dialog management component 222 to analyze the meaning of user speech and to determine how to respond to the user speech. The domain logic 224 may define rules and behaviors relating to different information or topic domains, such as news, traffic, weather, to-do lists, shopping lists, music, home automation, retail services, and so forth. The domain logic 224 maps spoken user statements to respective domains and is responsible for determining dialog responses and/or actions to perform in response to user utterances. Suppose, for example, that the user requests "Play music." In such an example, the domain logic 224 may identify the request as belonging to the music domain and may specify that the device 102 respond with the responsive speech "Play music by which artist?"

The speech processing components 210 may also have a text-to-speech or speech generation component 226 that converts text to audio for generation at the loudspeaker 114.

The device 102 has a speech activity detector 228 that detects the level of human speech presence in each of the directional audio signals produced by the beamforming component 216. The level of speech presence is detected by analyzing a portion of an audio signal to evaluate features of the audio signal such as signal energy and frequency distribution. The features are quantified and compared to reference features corresponding to reference signals that are known to contain human speech. The comparison produces a score corresponding to the degree of similarity between the features of the audio signal and the reference features. The score is used as an indication of the detected or likely level of speech presence in the audio signal. The speech activity detector 228 may be configured to continuously or repeatedly provide the level of speech presence each of the directional audio signals.

The device 102 has an expression detector 230 that receives and analyzes the directional audio signals produced by the beamforming component 216 to detect a predefined word, phrase, or other sound. In the described embodiment, the expression detector 230 is configured to detect a representation of a wake word or other trigger expression in one or more of the directional audio signals. Generally, the expression detector 230 analyzes an individual directional audio signal in response to an indication from the speech activity detector 228 that the directional audio signal contains at least certain level of speech presence.

The loudspeaker device 102 has a sound source localization (SSL) component 232 that is configured to analyze differences in arrival times of received sound at the respective microphones of the microphone array 112 in order to determine the position from which the received sound originated. For example, the SSL component 232 may use time-difference-of-arrival (TDOA) techniques to determine the position or direction of a sound source, as will be explained below with reference to FIGS. 4 and 5.

The loudspeaker device 102 also includes the controller/mixer 116, which is configured to associate different devices 102 with different audio channels and to route audio channel signals and/or mixes of audio channel signals to associated devices 102.

The device 102 may include a wide-area network (WAN) communications interface 234, which in this example comprises a Wi-Fi adapter or other wireless network interface. The WAN communications interface 234 is configured to communicate over the Internet or other communications network with the content source 120 and/or with other network-based services that may support the operation of the device 102.

The device 102 may have a personal-area networking (PAN) interface such as a Bluetooth® wireless interface 236. The Bluetooth interface 236 can be used for communications between individual loudspeaker devices 102. The Bluetooth interface 236 may also be used to receive content from local audio sources such as smartphones, personal media players, and so forth.

The device 102 may have a loudspeaker driver 238, such as an amplifier that receives a low-level audio signal representing speech generated by the speech generation component 226 and that converts the low-level signal to a higher-level signal for driving the loudspeaker 114. The loudspeaker driver may be programmable or otherwise settable to establish the amplification level of the loudspeaker 114.

The device 102 may have other hardware components 240 that are not shown, such as control buttons, batteries, power adapters, amplifiers, indicators, and so forth.

In some embodiments, certain functionality of the device 102 may be provided by supporting network-based services. In particular, the speech processing components 210 may be implemented by one or more servers of a network-based speech service that communicates with the loudspeaker device over the Internet and/or other data communication networks. As an example of this type of operation, the device 102 may be configured to detect an utterance of the trigger expression, and in response to begin streaming an audio signal containing subsequent user speech to network-based speech services over the Internet. The network-based speech services may perform ASR, NLU, dialog management, and speech generation. Upon identifying an intent of the user and/or an action that the user is requesting, the network-based speech services may direct the device 102 to perform an action and/or may perform an action using other network-based services. For example, the network-based speech services may determine that the user is requesting a taxi, and may communicate with an appropriate network-based service to summon a taxi to the location of the device 102. As another example, the network-based speech services may determine that the user is requesting speaker configuration, and may instruct the loudspeaker devices 102 to perform the configuration operations described herein. Generally, many of the functions described herein as being performed by the loudspeaker device 102 may be performed in whole or in part by such a supporting network-based service.

Figure 3:
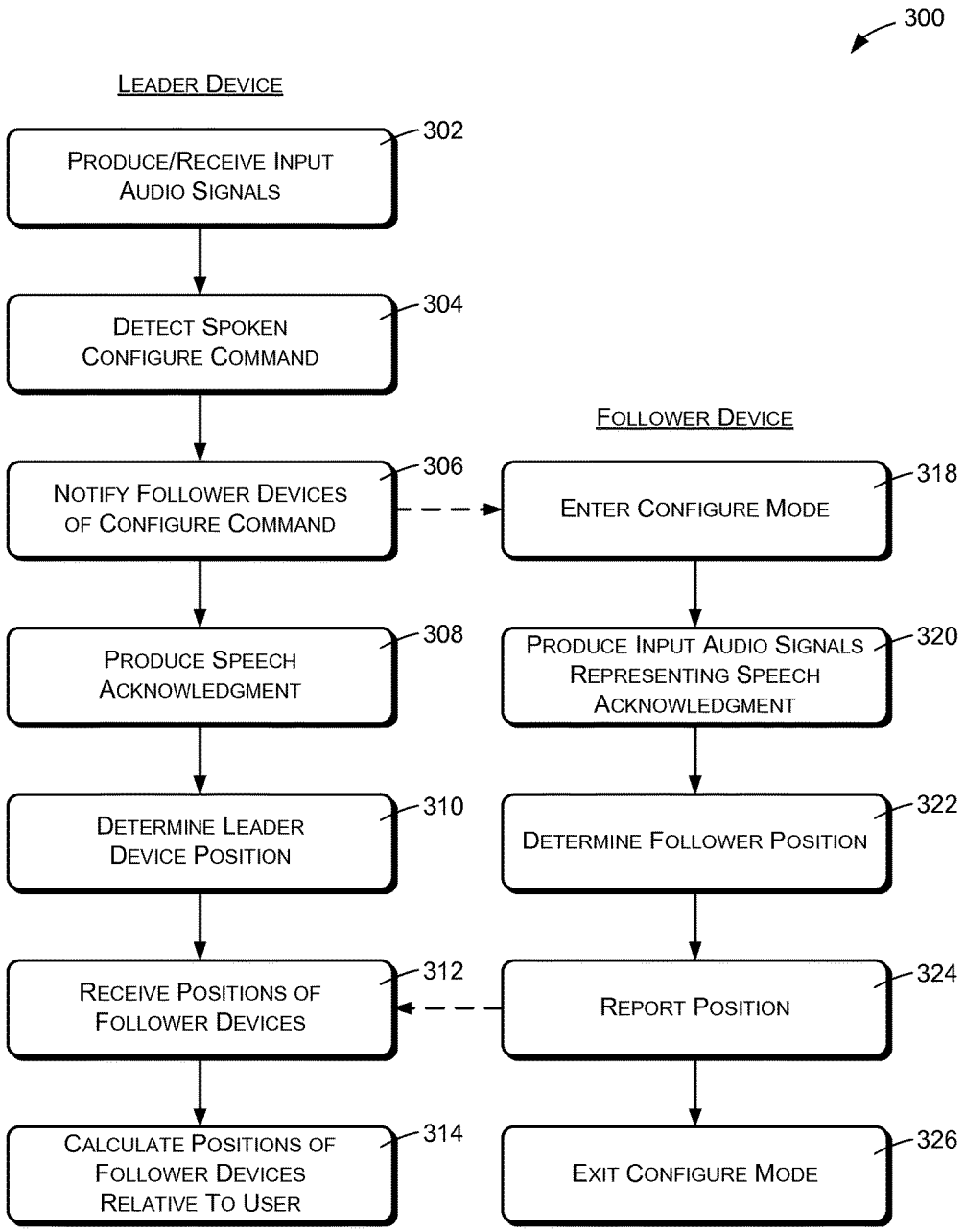
FIG. 3 is a flow diagram illustrating an example method of determining positions of multiple loudspeakers based on user speech and responsive speech produced by one of the loudspeaker devices.

FIG. 3 illustrates an example method 300 that may be performed in order to determine relative positions of the devices 102. Actions on the left side of FIG. 3 are performed by one of the loudspeaker devices 102 that is referred to as the "leader" device, which has been selected or designated to perform the functionality of the controller/mixer 116. Actions on the right side of FIG. 3 are performed by each of the devices 102 other than the leader device. For purposes of discussion, the actions on the right side of FIG. 3 will be described as being performed by a single "follower" device, although it should be understood that each device 102 other than the leader device performs the same actions. It is also understood that the devices 102 communicate with each other using Bluetooth® or another wired or wireless network communications technology in order to coordinate their actions. Dashed lines between the illustrated actions represent specific examples of communications between the leader and follower devices, although the devices may also perform other communications in order to synchronize and coordinate their operations.

In the described embodiments, each of the devices 102 has the same capabilities, and each device is capable of acting as a leader device and/or as a follower device. One of the devices 102 may be arbitrarily or randomly designated to be the leader device. Alternatively, the devices 102 may communicate with each other to dynamically designate a leader device in response to detecting a user command to configure the devices 102. For example, each device 102 that has detected the user command may report a speech activity level, produced by the speech activity detector 228 at the time the user command was detected, and the device reporting the highest speech activity level may be designated as the leader. Alternatively, each device may report the energy of the signal in which the command was detected and the device reporting the highest energy may be selected as the leader device. As yet another alternative, the first device to detect the user command may be designated as the leader device. As yet another alternative, the device that recognized the user speech with the highest ASR recognition confidence may be designated as the leader.

An action 302, performed by the designated leader device, comprises producing and/or receiving a first set of input audio signals representing sound received by the microphone array 112 of the leader device. For example, each microphone element 110 may produce a corresponding input audio signal of the first set. The input audio signals represent the received sound with different relative time offsets, resulting from the spacings of the microphone elements 110 and depending on the direction of the source of the sound relative to the microphone array 112. In the examples described, the received sound corresponds to speech of the user 104.

An action 304 comprises determining that the sound represented by the first set of input signals corresponds to a command spoken by the user 104 to perform an automatic speaker configuration. For example, the action 304 may comprise performing automatic speech recognition (ASR) on one or more of the first set of input audio signals to determine that the received sound comprises user speech, and that the user speech contains or corresponds to a predefined sequence of words such as "configure speakers." For example, the ASR component 218 may be used to analyze the input audio signals and determine that the user speech contains a predefined sequence of words. In some embodiments, the action 304 may include performing natural language understanding (NLU) to determine an intent of the user 104 to perform a speaker configuration. The NLU component 220 may be used to determine the intent based upon textual output from the ASR component 218, as an example. Furthermore, two-way speech dialogs may sometimes be used to interact with the user 104 to determine that the user 104 desires to configure the loudspeaker devices 102.

An action 306 comprises notifying follower devices that a configuration function is being or has been initiated. Actions performed by an example follower device in response to being notified of the initiation of the configuration function will be described in more detail below.

An action 308 comprises producing sound, using the loudspeaker 114 of the leader device, indicating that the user command has been received and is being acted upon. In the described embodiments, the sound may comprise speech that acknowledges the user command. For example, the leader device may use text-to-speech capabilities to produce the speech response "configuration initiated" or "speakers have been configured." As will be described below, the follower devices analyze this responsive speech to determine their positions relative to the leader device.

The leader device also performs an action 310 of determining the position of the user 104 relative to the leader device and hence the relative position of the leader device relative to the user 104. The action 310 may comprise analyzing sound received at the leader device to determine one or more position coordinates indicating at least the direction of the leader device relative to the user 104. More specifically, this may comprise analyzing the first set of input audio signals to determine the position of the leader device. The action 304 may be performed by analyzing differences in arrival times of the sound corresponding to the user speech, using techniques that are known as time-difference-of-arrival (TDOA) analyses. The action 304 may yield one or more position coordinates. As one example, the position coordinates may comprise or indicate a direction such as an angle or azimuth, corresponding to the position of the leader device 102 relative to the user 104. As another example, the position coordinates may indicate both a direction and a distance of the leader device relative to the user 104. In some cases, the position coordinates may comprise Cartesian coordinates. As used herein, the term "position" may correspond to any one or more of a direction, an angle, a Cartesian coordinate, a polar coordinate, a distance, etc.

An action 312 comprises receiving data indicating positions of the follower devices. Each follower device may report its position as one or more coordinates relative to the leader device 102. In alternative embodiments, each follower device may provide other data or information to the leader device, which may indirectly indicate the position of the follower device. For example, a follower device may receive the speech acknowledgement produced in the action 308 and may transmit audio signals, received respectively at the spaced microphones of the follower device, to the leader device. The leader device may perform TDOA analyses on the received audio signals to determine the position of the follower device.

An action 314 comprises calculating the position of the follower device 102 relative to the user 104. This may comprise, for a single follower device, adding each relative coordinate of the follower device to the corresponding relative coordinate of the leader device, wherein the coordinates of the leader device relative to the user have been already obtained in the action 310. Upon completion of the action 314, the positions of all follower devices are known relative to the user 104.

Moving now to actions shown on the right side of FIG. 3, which are performed by the follower device, an action 318 comprises entering a configure mode upon receiving a notification that the user 104 has spoken a configure command. An action 320 comprises producing and/or receiving a second set of input audio signals representing sound received by the microphone array 112 of the follower device. For example, each microphone element 110 of the follower device may produce a corresponding input audio signal of the second set. In this case, the sound corresponds to the speech acknowledgement produced by the leader device in the action 308. The input audio signals represent the sound with time offsets relative to each other, resulting from the spacings of the microphone elements 110 and depending on the direction of the leader device relative to the microphone array 112 of the follower device. In some cases, the leader device may provide timing information or notifications so that the follower device knows the time at which the speech acknowledgement is being produced and is to be expected. In other cases, the follower device may perform ASR to recognize the speech acknowledgement.

The follower device 102 also performs an action 322 of determining the position of the leader device relative to the follower device and hence the relative position of the follower device relative to the leader device. The action 322 may comprise analyzing sound received at the follower device to determine one or more position coordinates indicating at least the direction of the follower device relative to the leader device. More specifically, this may comprise analyzing the second set of input audio signals to determine the position of the leader device relative to the follower device 102. The action 322 may be performed using TDOA analysis to yield one or more coordinates of the leader device relative to the follower device. For example, the TDOA analysis may yield two-dimensional Cartesian coordinates, a direction, and/or a distance. Inverse coordinates may be calculated to determine the position of the follower device 102 relative to the leader device 102.

An action 324 comprises reporting the position of the follower device to the leader device. An action 326 comprises exiting the configure mode. Note that while the follower device is in the configure mode, it may have reduced functionality. In particular, it may be disabled from recognizing or responding to commands spoken by the user 104.

Figure 4:
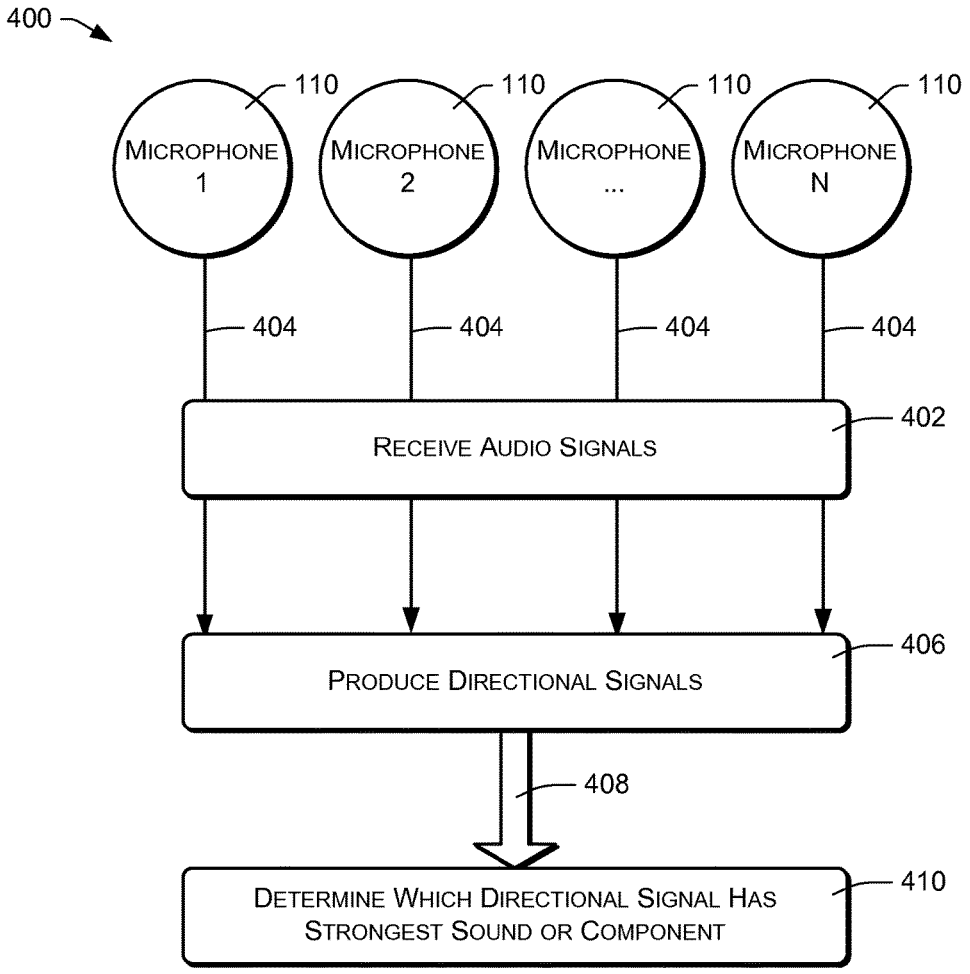
FIG. 4 is a flow diagram illustrating an example method of determining the position of a sound source based on microphone signals produced by a microphone array.

FIG. 4 illustrates an example method 400 of determining the position of a sound source relative to a device 102 using TDOA techniques known as beamforming. The method 400 may be used by the actions 310 and 322 of FIG. 3. In this example, the method determines a direction of the sound source, such as may be indicated by an azimuth angle.

An action 402 comprises receiving audio signals 404 from the microphones 110 of the device 102. An individual audio signal 404 is received from each of the microphones 110. Each signal 404 comprises a sequence of amplitudes or energy values. The signals 404 represent the same sound at different time offsets, depending on the position of the source of the sound and on the positional configuration of the microphone elements 110. In the case of the leader device, the sound corresponds to the user command to configure the loudspeakers. In the case of a follower device, the sound corresponds to the speech response produced by the leader device.

An action 406 comprises producing directional audio signals 408 based on the microphone signals 404. The directional audio signals 408 may be produced by the beamforming component 216 so that each of the directional audio signals 408 emphasizes sound from a different direction relative to the device 102. As an example, for the device shown in FIG. 1, the six hexagonally arranged microphone elements 110 may be used in pairs, where each pair comprises two microphone elements 110 that are 180 degrees opposite each other. The audio signal produced by one of the two microphones is delayed with respect to the other of the two microphone signals by an amount that is equal to the time it takes for a sound wave to travel the distance separating the two microphones. The two microphone signals are then added or multiplied on a sample-by-sample basis. This has the effect of amplifying sounds originating from the direction formed by a ray from one of the two microphone elements through the other of the two microphone elements, while attenuating sounds originating from other directions. The negative of the same time difference can be used to emphasize sounds from the opposite direction. Because there are three pairs of opposite microphone elements, this technique can be used to form six directional audio signals, each emphasizing sound from a different direction.

An action 410 comprises determining which of the directional audio signals 408 has the highest sound level or speech activity level and concluding that that directional audio signal corresponds to the direction of the sound source. Speech activity levels may be evaluated by the speech activity detector 228.

Rather than using beamforming, the microphone elements themselves may be directional, and may produce audio signals emphasizing sound from respectively different directions.

Figure 5:
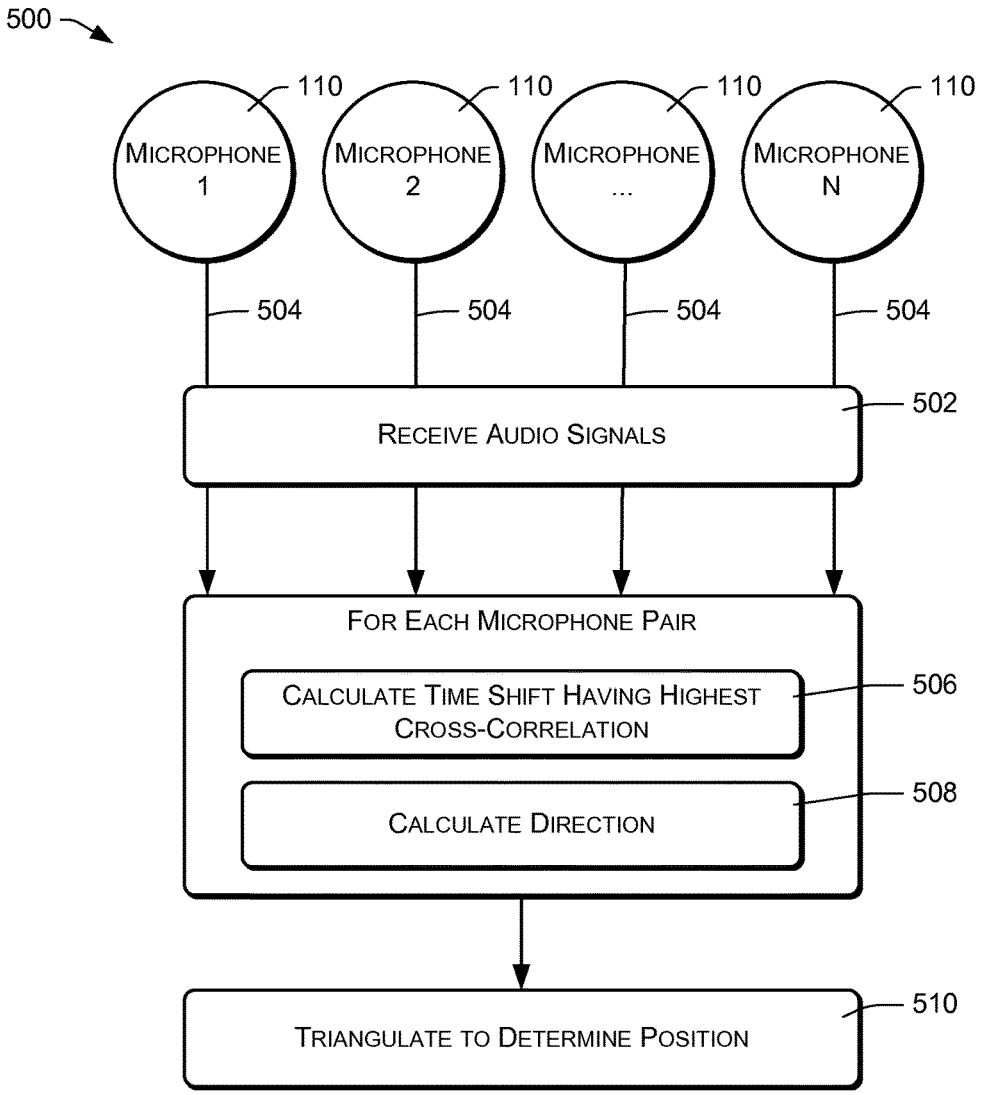
FIG. 5 is a flow diagram illustrating another example method of determining the position of a sound source based on microphone signals produced by a microphone array.

FIG. 5 illustrates an example method 500 of determining the position of a sound source relative to a device 102 using alternative TDOA techniques. The method 500 may be used by the actions 310 and 322 of FIG. 3. In this example, the determined position may comprise both a direction and a distance. Generally, the method 500 comprises evaluating a difference in arrival times An action 502 comprises receiving audio signals 504 from the microphones 110 of the device 102. An individual audio signal 504 is received from each of the microphones 110. Each signal 504 comprises a sequence of amplitudes or energy values. The signals 504 represent the same sound at different time offsets, depending on the position of the source of the sound and on the positional configuration of the microphone elements 110. In the case of the leader device, the sound corresponds to the user command to configure the loudspeakers. In the case of a follower device, the sound corresponds to the speech response produced by the leader device.

Actions 506 and 508 are performed for every possible pairing of two microphones 110, not limited to opposing pairs of microphones. For a single pair of microphones 110, the action 506 comprises determining a time shift between the two microphone signals that produces the highest cross-correlation of the two microphone signals. The determined time shift indicates the difference in the times of arrival of a particular sound arriving at each of the two microphones. An action 506 comprises determining the direction from which the sound originated relative to one or the other of the two microphones, based on the determined time difference, the known positions of the microphones 110 relative to each other and to the top surface 108 of the device 102, and based on the known speed of sound.

The actions 506 and 508 result in a set of directions, each direction being of the sound source relative to a respective pair of the microphones 110. An action 510 comprises triangulating based on the directions and the known positions of the microphones 110 to determine the position of the sound source relative to the device 102.

When using a type of sound source localization that determines only a one-dimensional position of a sound source, such as an angular direction or azimuth of the sound source, additional mechanisms or techniques may in some cases be used to determine a second dimension such as distance. As one example, the sound output by the leader device 102 may be calibrated to a known loudness and each of the follower devices 102 may calculate its distance from the leader device based on the received energy level of the sound, based on the known attenuation of sound as a function of distance.

More generally, distances between a first device and a second device may in some implementations be obtained by determining a signal energy of a signal received by the second device, such as an audio signal or a radio-frequency signal emitted by the first device. Such a signal may comprise an audio signal, a radio-frequency signals, a light signal, etc.

As another example, distance determinations may be based on technologies such as ultra-wideband (UWB) communications and associated protocols that use time-of-flight measurements for distance ranging. For example, the devices 102 may communicate using a communications protocol as defined by the IEEE 802.15.4a standard, which relates to the use of direct sequence UWB for ToF distance ranging. As another example, the devices 102 may communicate and perform distance ranging using one or more variations of the IEEE 802.11 wireless communications protocol, which may at times be referred to as Wi-Fi. Using Wi-Fi for distance ranging may be desirable in environments where Wi-Fi is already being used, in order to avoid having to incorporate additional hardware in the devices 102. Distance ranging may be implemented within one of the communications layers specified by the 802.11 protocol, such as the TCP (Transmission Control Protocol) layer, the UDP (User Datagram Protocol) layer, or another layer of the 802.11 protocol stack.

Figure 6:
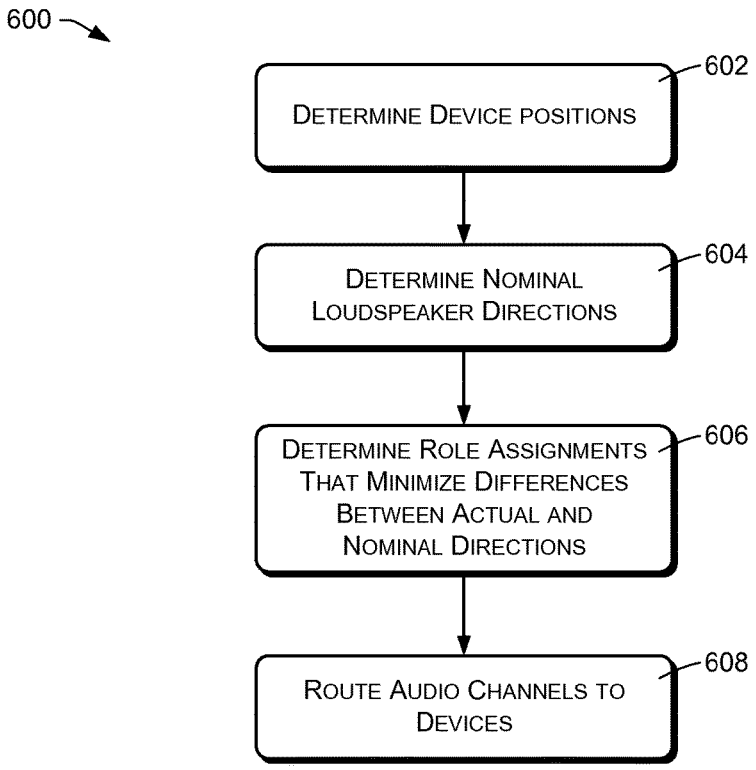
FIG. 6 is a flow diagram illustrating an example method of associating audio channels with loudspeaker devices based on their positions.

FIG. 6 illustrates an example method of configuring the roles of the loudspeaker devices 102 and thereby associating each loudspeaker device with one or more signals of a multi-channel audio signal. An action 602 comprises determining positions of the loudspeaker devices relative to the user 104. This may be performed in accordance with the method 300 of FIG. 3. In certain implementations, the position of each loudspeaker device may be determined as a direction, such as an azimuth, of each device 102 relative to the user. In certain implementations, the position may also be defined by a distance between the user and each of the devices 102.

An action 604 comprises determining or obtaining reference loudspeaker positions. For example, the action 604 may be based on a surround sound specification or a reference loudspeaker layout, which identifies the ideal directions of loudspeakers relative to the user 104 for a particular type of audio system.

An action 606 comprises determining role assignments, such as by determining a correspondence between each device 102 and one or more of the audio channel signals. Generally, this comprises comparing the positions of the devices 102 to reference positions specified by a reference loudspeaker layout and selecting a role assignment of speakers that most closely resembles the reference layout. As an example, the action 606 may comprise determining that the position of a first loudspeaker device relative to the user 104 corresponds to the a first reference position that has been associated with a first audio channel signal by a reference loudspeaker layout, and that the position of a second loudspeaker device relative to the user 104 corresponds to the a second reference position that has been associated with a second audio channel signal by the reference loudspeaker layout.

In some embodiments, the action 606 may comprise evaluating every possible combination of assignments of channels to devices and selecting the combination that minimizes the differences between actual and reference loudspeaker directions. For example, the action 606 may comprise (a) calculating a first difference between the position of a particular loudspeaker and a first reference position, (b) calculating a second difference between the position of the particular loudspeaker and a second reference position, (c) determine which of the first and second differences is smaller, and (d) assign the particular loudspeaker to the role of the reference position that has the smallest difference between itself and the particular loudspeaker.

An action 608 comprises sending audio channel signals to the devices 102 in accordance with the determined role assignments and associations of audio channel signals with loudspeaker devices. For example, in the case where a particular audio channel signal has been associated with a particular device, the audio channel signal is routed to the particular device.

In some embodiments, the controller/mixer 116, which may be implemented by the leader device, may receive all of the audio channel signals and may retransmit the appropriate channel signal to each follower device. In other cases, the controller/mixer 116 may instruct the content source 120 to provide specified channel signals or channel signal mixes to certain devices. As yet another alternative, the controller/mixer 116 may instruct each loudspeaker device 102 regarding which audio channel signal or mix of audio channels to obtain and/or play from the content source 120. An audio signal mix of two signals comprises a portion of a first signal and a portion of a second signal.

In some cases, it may be that the actual position of a device 102 is between the reference positions associated with two adjacent audio channel signals. In this case, the audio channel signals corresponding to both of the adjacent audio channels may be routed to the device 102. More specifically, the controller/mixer 116 or another component of the system 100 may define or create a mix of the audio channel signals containing a portion of the first audio channel signal and a portion of the second audio channel signal, and may provide the resulting mixed audio signal to the device 102. The mixed audio signal may contain a first percentage of the first of the two channels and a second percentage of the second of the two channels, where the percentages are calculated to reflect the relative position of the device 102 in relation to the adjacent reference positions.

Generally, the described functionality, including determining positions, associating audio channel signals with loudspeaker devices, and routing audio signals, may be performed by any one or more of the loudspeaker devices in the system 100. In some cases, supporting network-based services may also be used to perform some of the described functionality. For example, the association of audio channel signals to particular devices may be communicated to network-based services such as the content source 120, and the content source may send the appropriate audio signals or audio signal mixes to the associated devices.

Figure 7:
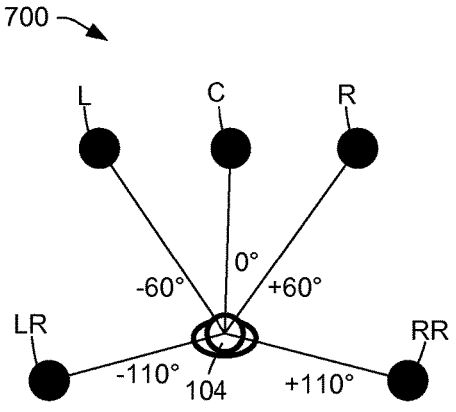
FIGS. 7 and 8 are block diagrams illustrating examples of loudspeaker layouts.

FIG. 7 illustrates an example of a device layout 700 in which the individual devices 102 have been placed in positions corresponding to reference positions defined by a surround sound standard. In this example, a center "C" device is directly in front of the user 104. The position of the center device relative to the user defines a reference angle of 0°. A right "R" device is at +60° relative to the reference angle. A left "L" device is at −60° relative to the reference angle. A right rear "RR" device is at +110° relative to the reference angle. A left rear "LR" device is at −110° relative to the reference angle. Each device receives an audio signal corresponding to its assigned role.

Figure 8:
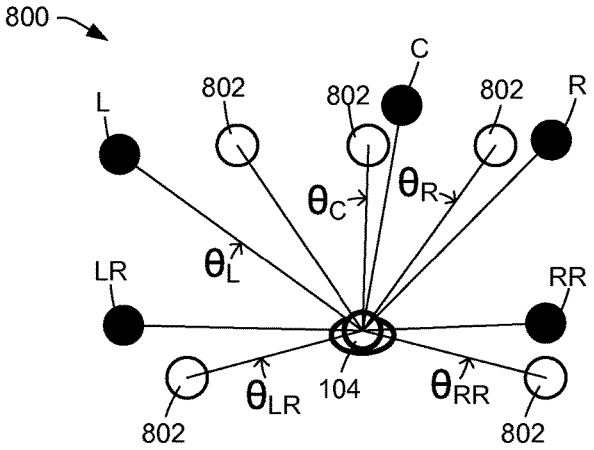

FIG. 8 shows an example of a device layout 800 in which the devices 102 have been placed at positions that differ from the reference positions defined by the surround sound standard. In this example, reference positions 802 are shown as circles. The actual positions of the devices 102 result in angular differences θ, wherein each angular difference θ is the difference between the actual angle of the device 102 relative to the user 104 and the reference angle of the device 102 relative to the user 104: $\theta_{LR}$ is the difference between the actual and reference angles of the left rear "LR" device; $\theta_L$ is the difference between the actual and reference angles of the left "L" device; $\theta_C$ is the difference between the actual and reference angles of the center "C" device; $\theta_R$ is the difference between the actual and reference angles of the right "R" device; and $\theta_{RR}$ is the difference between the actual and reference angles of the right rear "RR" device.

In a case such as this, the controller/mixer 116 may determine role assignments and channel signal assignments by determining which of multiple possible assignment combinations minimizes a sum of the differences θ. In cases where the directions of the devices 102 are known relative to the user 104, the reference directions may be defined with respect to a fixed reference corresponding to the direction that the user is facing or to a direction between the user and a selected one of the devices 102 that the user is nearest. For example, it may be assumed that the device nearest the user 104 is to have the C role. As another example, it may be assumed that the device that has been designated as being the leader device is in front of the user 104 and is to be assigned the "C" role.

In some implementations, as mentioned above, the controller/mixer 116 may configure a device 102 to receive a mix of two audio channel signals. For example, the controller/mixer 116 may determine that a particular device is between two reference speaker positions and may provide an audio signal that is a mix of the audio channels that are associated with those reference positions. As a more specific example, suppose that a device 102 is at an angle that is 30% between the reference position associated with a first channel and the reference position associated with a second channel. In this case, 30% of the device audio signal may consist of the first channel and 70% of the device audio signal may consist of the second channel.

Figure 9:
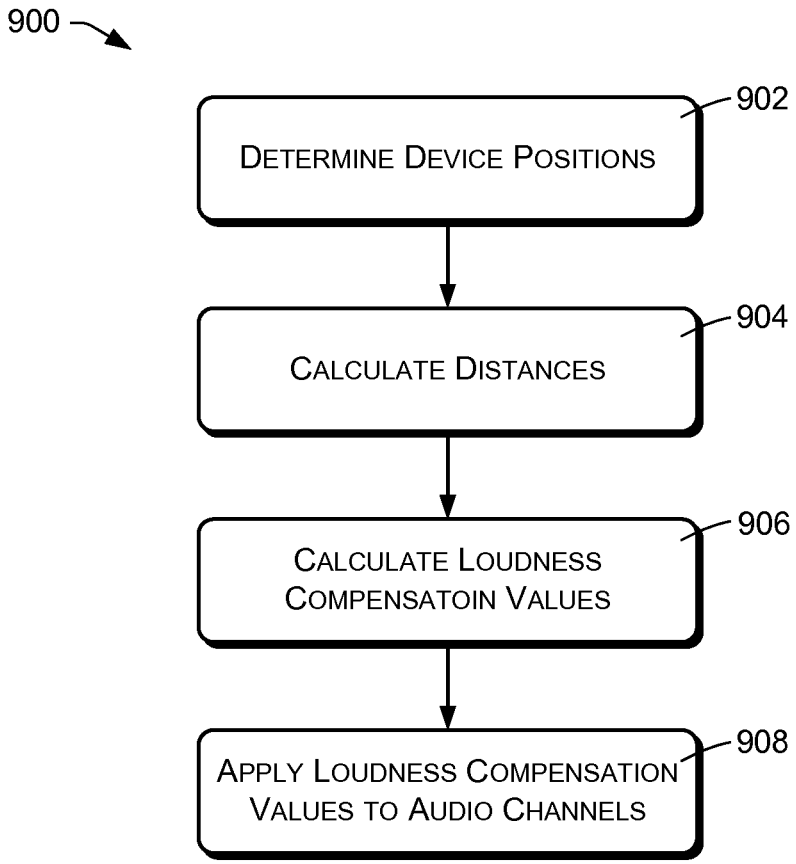
FIG. 9 is a flow diagram illustrating an example method of configuring loudnesses of loudspeakers based on their positions.

FIG. 9 shows an example method 900 of configuring loudnesses or amplification levels of individual loudspeaker devices 102 based on their distances from the user 104. An action 902 comprises determining positions of the devices relative to the user 104, such as by performing the method 300 of FIG. 3. An action 904 comprises calculating a distance between the user and the first loudspeaker device based at least in part on position of the first loudspeaker device.

An action 906 comprises determining an amplification level for each device 102, based on the distance of the device 102 from the user. The amplification levels are selected or calculated so that the user 104 perceives sound generated from an audio signal to have the same loudness, regardless of which loudspeaker device it is played on.

An action 908 comprises applying the amplification levels to the audio channels of the multi-channel audio signal, such as by setting the loudspeaker driver 238 to apply the determined amplification level to a received audio signal. In some cases, the amplification levels may be provided to the respective loudspeaker devices. In other cases, the controller/mixer 116 may amplify or attenuate the audio signals in accordance with the determined amplification values. In yet other cases, the amplification levels may be provided to the content source 120, which may be responsible for adjusting the audio signals in accordance with the determined amplification values.

Although the subject matter has been described in language specific to certain features, it is to be understood that the subject matter defined in the appended claims is not necessarily limited to the specific features described. Rather, the specific features are disclosed as illustrative forms of implementing the claims.

What is claimed is:

1. An audio system comprising:

multiple loudspeaker devices, each loudspeaker device comprising:

a loudspeaker;

multiple microphones, each microphone producing an input audio signal representing received sound; and one or more processors;

a first loudspeaker device comprising one or more first computer-readable media storing computer-executable instructions that, when executed by one or more processors of the first loudspeaker device, cause the one or more processors of the first loudspeaker device to perform first actions comprising:

receiving a first set of input audio signals produced by first microphones of the first loudspeaker device, each of the first set of input audio signals representing first sound;

determining that the first sound corresponds to a command spoken by a user;

analyzing the first set of input audio signals to determine a first relative position of the first loudspeaker device relative to the user; and producing second sound using the loudspeaker of the first loudspeaker device, the second sound comprising speech that acknowledges the command;

a second loudspeaker device comprising one or more second computer-readable media storing computer-executable instructions that, when executed by one or more processors of the second loudspeaker device, cause the one or more processors of the second loudspeaker device to perform second actions comprising:

receiving a second set of input audio signals produced by second microphones of the second loudspeaker device, each of the second set of input audio signals representing the second sound; and analyzing the second set of input audio signals to determine a second relative position, the second relative position being of the second loudspeaker device relative to the first loudspeaker device; and at least one loudspeaker device of the multiple loudspeaker devices comprising one or more third computer-readable media storing computer-executable instructions that, when executed by one or more processors of the at least one loudspeaker device, cause the one or more processors of the at least one loudspeaker device to perform third actions comprising:

determining, based at least partly on a position of the user, a reference loudspeaker layout that includes at least a first reference position corresponding to a first audio channel signal of a multi-channel audio signal and a second reference position corresponding to a second audio channel signal of the multi-channel audio signal;

determining that the first relative position corresponds to the first reference position; and sending the first audio channel signal to the first loudspeaker device.

2. The audio system of claim 1, wherein determining that the first relative position corresponds to the first reference position comprises:

calculating a first difference between the first relative position and the first reference position;

calculating a second difference between the first relative position and the second reference position; and determining that the first difference is less than the second difference.

3. The audio system of claim 1, the third actions further comprising:

determining an amplification level for the first loudspeaker device based at least in part on the first relative position; and setting a loudspeaker driver to apply the amplification level.

4. A method comprising:

receiving, by one or more loudspeaker devices, a first set of input audio signals representing a first sound, each loudspeaker device of the one or more loudspeaker devices including a loudspeaker, multiple microphones, and one or more processors;

receiving, by at least one of the one or more loudspeaker devices, an indication that the first sound corresponds to a command spoken by a user;

analyzing, by at least one of the one or more loudspeaker devices, the first set of input audio signals to determine a first position of a first loudspeaker device of the one or more loudspeaker devices relative to the user;

producing, by at least one of the one or more loudspeaker devices, a second sound that acknowledges the command spoken by the user;

receiving, by at least one of the one or more loudspeaker devices, position data that indicates a second position of a second loudspeaker device of the one or more loudspeaker devices relative to the first loudspeaker device;

determining, by at least one of the one or more loudspeaker devices and based at least partly on a position of the user, a reference loudspeaker layout that includes at least a first reference position corresponding to a first audio channel signal of a multi-channel audio signal and a second reference position corresponding to a second audio channel signal of the multi-channel audio signal;

determining, by at least one of the one or more loudspeaker devices, a first difference between the second position and the first reference position; and determining, by at least one of the one or more loudspeaker devices and based at least partly on the first difference, a first correspondence between the first audio channel signal and the second loudspeaker device.

5. The method of claim 4, wherein receiving the position data comprises receiving a second set of input audio signals from the second loudspeaker device, the second set of input audio signals representing the second sound.

6. The method of claim 4, wherein receiving the position data comprises receiving at least a direction coordinate of the second loudspeaker device relative to the first loudspeaker device.

7. The method of claim 4, wherein producing the second sound comprises producing speech in response to the command spoken by the user.

8. The method of claim 4, further comprising:

receiving, at the second loudspeaker device, a second set of input audio signals representing the second sound; and analyzing the second set of input audio signals to determine the second position.

9. The method of claim 4, further comprising determining a second correspondence between the second audio channel signal and the first loudspeaker device based at least in part on the first position.

10. The method of claim 4, wherein determining the first correspondence further comprises:

calculating a second difference between the second position and the second reference position; and determining that the first difference is less than the second difference.

11. The method of claim 4, further comprising sending the first audio channel signal to the second loudspeaker device.

12. The method of claim 4, further comprising:

determining, based at least in part on the second position, that the second loudspeaker device is between the first reference position and the second reference position; and sending a portion of the first audio channel signal and a portion of the second audio channel signal to the second loudspeaker device.

13. The method of claim 4, further comprising:

performing automatic speech recognition on one or more audio signals of the first set of input audio signals; and producing the indication that the first sound corresponds to the command spoken by the user.

14. The method of claim 4, wherein analyzing the first set of input audio signals comprises:

determining an additional difference between an arrival time of the first sound at a first microphone of the first loudspeaker device and an arrival time of the first sound at a second microphone of the first loudspeaker device; and calculating a direction of the user relative to the first loudspeaker device based at least in part on the additional difference and based at least in part on the known speed of sound.

15. The method of claim 4, further comprising:

determining an amplification level for the first loudspeaker device based at least in part on the first position; and setting a loudspeaker driver of the first loudspeaker device to apply the amplification level.

16. The method of claim 4, wherein analyzing the first set of input audio signals comprises determining a signal energy of at least one input audio signal of the first set of input audio signals.

17. A method, comprising:

receiving, by a first loudspeaker device including a loudspeaker, multiple microphones, and one or more processors, sound from a second loudspeaker device;

analyzing, by the first loudspeaker device, the sound to determine a first position, the first position being of the first loudspeaker device relative to the second loudspeaker device;

determining, by the first loudspeaker device and based at least partly on a position of a user, a reference loudspeaker layout that includes at least a first reference position corresponding to a first audio channel signal of a multi-channel audio signal and a second reference position corresponding to a second audio channel signal of the multi-channel audio signal;

calculating, by the first loudspeaker device, a first difference between the first position and the first reference position; and determining, by the first loudspeaker device and based at least partly on the first difference, a correspondence between the first audio channel signal and the first loudspeaker device.

18. The method of claim 17, wherein the sound comprises speech produced by the second loudspeaker device.

19. The method of claim 17, wherein the sound is produced by the second loudspeaker device for interaction with the user.

20. The method of claim 17, wherein determining the correspondence further comprises:

calculating a second difference between the first position and the second reference position; and determining that the first difference is less than the second difference.

21. The method of claim 17, further comprising sending the first audio channel signal to the first loudspeaker device.

22. The method of claim 17, further comprising:

determining that the first loudspeaker device is between the first reference position and the second reference position; and producing additional sound based at least in part on a portion of the first audio channel signal and a portion of the second audio channel signal.

23. The method of claim 17, wherein analyzing the sound comprises:

determining an additional difference between an arrival time of the sound at a first microphone of the first loudspeaker device and an arrival time of the sound at a second microphone of the first loudspeaker device; and calculating a direction relative to the first loudspeaker device based at least in part on the additional difference and based at least in part on the known speed of sound.

* * * * *